United States Patent [19]

Hsi

[11] 4,341,049

[45] Jul. 27, 1982

[54] SYSTEM FOR BUILDING WALL CONSTRUCTION

[75] Inventor: Peter H. Y. Hsi, Honolulu, Hi.

[73] Assignee: MPH Ltd., Honolulu, Hi.

[21] Appl. No.: 50,600

[22] Filed: Jun. 21, 1979

[51] Int. Cl.[3] ..... F04B 2/38

[52] U.S. Cl. ..... 52/421; 52/98; 52/439; 52/309.3

[58] Field of Search ..... 52/607, 438, 421, 437, 52/439, 505, 98

[56] References Cited

U.S. PATENT DOCUMENTS

| | | | |
|---|---|---|---|
| 2,781,657 | 2/1957 | Taylor | 52/98 |
| 2,881,614 | 4/1959 | Preininger | 52/438 |
| 2,911,817 | 11/1959 | Smith | 52/424 |
| 2,994,162 | 8/1961 | Frantz | 52/437 |
| 3,166,873 | 1/1965 | Rosenfeld | 52/439 |
| 3,222,830 | 12/1965 | Ivanz | 52/438 |
| 3,236,015 | 2/1966 | Rubenstein | 52/309.3 |
| 4,091,587 | 5/1978 | Depka | 52/421 |

FOREIGN PATENT DOCUMENTS

| | | | |
|---|---|---|---|
| 2251989 | 5/1974 | Fed. Rep. of Germany | 52/607 |
| 633832 | 10/1927 | France | 52/251 |
| 1024717 | 4/1953 | France | 52/284 |
| 545064 | 5/1942 | United Kingdom | 52/98 |

*Primary Examiner*—John E. Murtagh

*Attorney, Agent, or Firm*—Schapp and Hatch

[57] ABSTRACT

Constructing building walls from concrete blocks having flattened rectangular facing members held in parallel spaced relation by integral transverse webs spaced from the ends of the block by a distance equal to one-half the distance between the webs and providing a pair of V-shaped reinforcing of receiving notches having straight sides inclined at an angle of substantially 45°. The blocks are stacked in equally staggered courses to define the wall panel and are held in position by a bonding agent securing the confronting surfaces of the blocks to each other with substantially no space therebetween. Vertical reinforcing rods are positioned in the vertically extending openings provided by the aligned webs of the blocks, and horizontal reinforcing rods are supported in the V-shaped notches, with the shape of the notches causing the rods to settle into desired positions on opposite sides of the vertical reinforcing rods. Liquid concrete grout is poured into desired vertical openings, and cast concrete closure members are mounted across the apertures between the webs and the lower sides of the aligned superjacent webs to confine the grout against leaking into the adjacent vertical opening. Recesses in the facing members provide relatively thin knockout panels which, when removed, provide access to the interior of the wall.

9 Claims, 14 Drawing Figures

SYSTEM FOR BUILDING WALL CONSTRUCTION

BACKGROUND OF THE INVENTION

1. Field of the Invention

The present invention relates to methods and apparatus for constructing building walls from hollow concrete building blocks, and more particularly to the building of reinforced concrete walls in situ without the use of separate forms.

2. Description of the Prior Art

It has previously been known to make building blocks with flattened, rectangular facing members held in parallel spaced relation by integral transverse webs, and to lay such blocks in stacked courses to provide a wall. The transverse webs are positioned in vertical alignment when the blocks are either stacked in alignment or staggered so that the joint between adjacent blocks is midway between the ends of the superjacent and subjacent blocks.

In this type of construction, the aligned webs provide vertical openings of substantially uniform cross section extending vertically the entire height of the wall section. Vertical reinforcing rods are positioned in these vertically extending openings, and horizontal rods are cradled in notches formed in the upper ends of the webs. With the reinforcing rods in place, liquid concrete grout is poured into the vertically extending openings. Where all of the openings are so filled, the resulting wall is substantially solid and monolithic. Where only some of the vertical openings are filled, the wall in effect provides reinforced columns alternating with open voids so as to substantially lighten the wall.

An example of the described construction is found in U.S. Pat. No. 3,222,830 to Geroge R. Ivany, issued Dec. 14, 1965.

While providing impressive advantages over previous constructions, the described prior art walls and wall panels also possess several disadvantages. Among these are: difficulties in positioning the horizontal reinforcing rods when different sizes of reinforcing rods are used; lack of an effective means for sealing off adjacent vertical openings from each other to prevent migration or leaking of the liquid grout through the notches and the openings between the stacked blocks and into the opening intended to be left empty; the lack of any means for providing horizontally extending passages capable of defining a horizontally extending reinforced beam area into which liquid concrete grout may be poured; the lack of provision within the wall panel for mounting of electrical conduits, piping, and the like; and the problems encountered in obtaining uniform distribution of the liquid grout all the way to the bottom of the wall panel without air pockets or other irregularities. Such disabilities seriously limit the utility of the basic wall construction.

SUMMARY OF THE INVENTION

The system for building wall construction of the present invention overcomes the described disadvantages of the prior art and greatly increases the versatility, utility, durability and appearance of the completed wall. In the present Invention, the shape and dimensioning of the supporting grooves in the webs functions automatically to position the horizontal reinforcing rods in desired locations when different sizes of reinforcing rods are used; dam means is provided for sealing off the adjacent vertical openings from each other when it is desired to prevent leaking of the liquid grout through the notches and the openings between the stacked blocks; and blocks having continuous bottoms extending across the openings between the facing members cooperate to provide horizontally extending passages capable of defining horizontally extending reinforced beam areas into which the liquid concrete grout may be poured so that the resulting wall structure incorporates both integral columns and beams within the interior of the wall structure. Provision is made for mounting the electrical conduits, piping, vacuum cleaning conduits, and ventilation and heating conduits within the wall panels.

Recesses in the inner faces of the facing members provide thin, easily removed knock-out panels providing access to the interior of the wall for electrical, water and air connections to the conduits carried within the wall. In this regard, the recesses also provide space for mounting apparatus such as electrical switches, wall plugs, terminal boxes, pipe nipples, etc. essentially flush with the surface of the wall so as not to interfere with the wall's smooth appearance. The knock-out panels also facilitate obtaining uniform distribution of the liquid grout all the way to the bottom of the wall panel without air pockets or other irregularities.

Walls and wall panels constructed in accordance with the present invention provides a neat, finished appearance eliminating thick grout lines between the blocks and resulting irregularities in vertical and horizontal alignment of the blocks, as is often encountered in conventional walls wherein the blocks are spaced apart by a thick layer of grout or mortar.

It is therefore an object of the present invention to provide a system for building wall construction which is adapted for construction of varying types of wall structures possessing very favorable strength to weight ratios.

Another object of the present invention is to provide a system for building wall construction in which the electrical apparatus, plumbing, and the like may be easily and readily incorporated into the wall structure so as to be concealed and protected therein, while still providing a minimum of structure at the exterior of the wall.

A further object of the present invention is to provide a building wall construction of the character described in which the reinforcing rods are automatically positioned in the most effective location as they are laid in place, even though the diameters of the reinforcing rods may differ.

A still further object of the present invention is to provide a system for building wall construction of the character set forth in which adjacent vertical openings are sealed off from each other for preventing leaking of liquid grout from vertical openings being filled into vertical openings intended to be left unfilled.

Yet another of the present invention is to provide a system for building wall construction of the character described in which the walls may be formed with both vertically extending reinforced columns and horizontally extending reinforced beams joining said columns, all integrally contained within an otherwise generally hollow wall.

A further object of the present invention is to provide a system for building wall construction of the character set forth in which electrical conduits, piping, and the like are readily contained within the wall panel, and provision is made for removing thinned portions of the facing members to provide access to such conduits, etc. and to accommodate flush mounting of switches, wall plugs, and the like.

Yet another object of the present invention is to provide a system for building wall construction in which provision is made for uniform distribution of the liquid grout all the way to the bottom of the wall panel without air pockets or other irregularities.

A still further object of the present invention is to provide a system for building wall construction of the character described in which the facing members of the individual building blocks are securely keyed onto the portions of the wall formed by hardened liquid concrete grout.

For a fuller understanding of the nature and further objects and features of advantage of the present invention, reference should be had to the following detailed description, taken in connection with the accompanying drawings and the appended claims.

Figure 2:
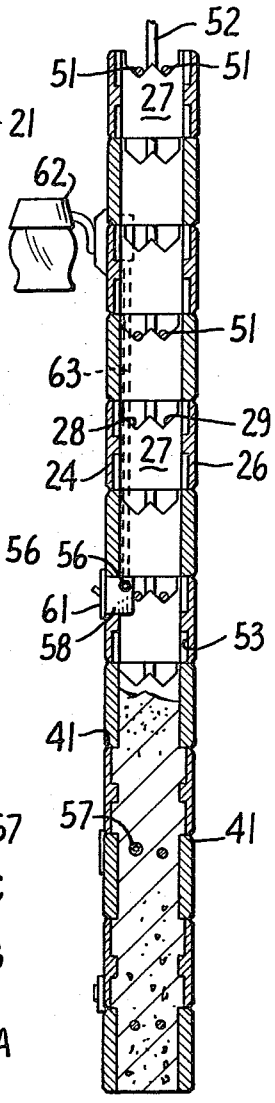
FIG. 2 is a vertical cross-sectional view taken substantially on the plane of line 2—2 of FIG. 1.

While only the preferred embodiments of the invention have been illustrated in the drawings, it will be apparent as the specification progresses that modifications could be made to the illustrated structure within the ambit of the claims.

DESCRIPTION OF THE PREFERRED EMBODIMENTS

Referring now to the drawings in detail, it will be seen that the system for building wall construction of the present invention is adapted for fabricating integral walls, or wall panels, 21 from a plurality of rectangular cementitious blocks 22 laid up in stacked courses 23, with each of the blocks 22 having portions relieved to provide a pair of flattened rectangular facing members 24 and 26 held in parallel spaced relation by parallel spaced integral transverse webs 27. The webs 27 are cut away at the upper sides of the blocks to provide a pair of V-shaped notches 28 and 29 having straight sides inclined at an angle of substantially 45° from the upper sides of the blocks, the webs being spaced from the ends of each of said blocks by a distance equal to one-half the distance between the webs, whereby the webs are substantially vertically aligned and the relieved portions 31, 32 and 33 form vertically aligned openings 34 when the blocks 22 are laid in either one-half overlapping or vertically aligned courses.

The upper face 36 of block 22, and the lower face 37 and end faces 38 and 39 not so relieved are substantially planar. The confronting faces of the blocks are secured together by a layer of bonding agent 41, such as a polymerizable epoxy resin. Preferably, these confronting faces are much smoother than is usual in cast concrete building blocks and, for this purpose, may be ground or otherwise smoothed after casting. This smoothness, together with the strongly bonding character of the epoxy resin, makes it possible for the layer of bonding agent 41 to be of insignificant thickness, say from 1/32" to 1/16". This greatly facilitates building the wall to precise measurements by eliminating the usual layers of grout or mortar between the blocks. The close fitting of the blocks 22 enhances the appearance of the finished wall or wall panel, and the appearance may be further enhanced by beveling all four edges of the outer faces of facing members 24 and 26, as illustrated at 42.

In accordance with the present invention, selected ones of the vertically extending aligned openings 34 are filled with liquid concrete grout compatible with the cast concrete material of the blocks 22 so that, upon hardening of the grout, the wall structure is able to bear increased loads. In this connection, it should be noted that the blocks are preferably made of high density, high strength concrete. This cooperates with the epoxy bonding of the blocks together to permit significantly thinner facing members 24 and 26, and webs 27, than would otherwise be required. Also, when the blocks are utilized in the building wall construction of the present invention, the width of the blocks (and corresponding thickness of the wall) is significantly reduced, thus effecting savings in both weight and materials.

Figure 4:
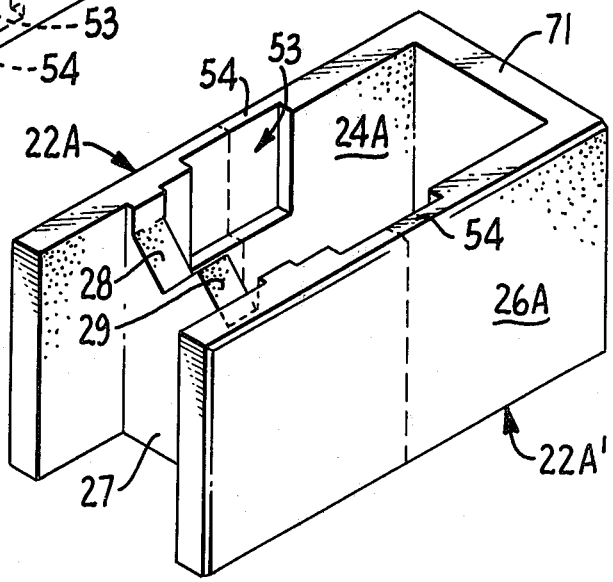
FIG. 4 is a perspective view similar to that of FIG. 3, but illustrating a modified form of the block of FIG. 3 adapted for constructing the ends of wall panels.
Figure 5:
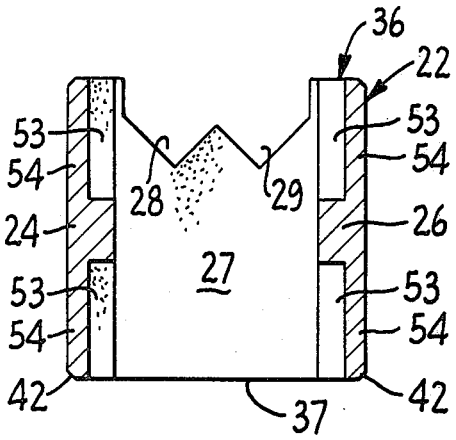
FIG. 5 is a vertical transverse cross-sectional view taken substantially on the plane of line 5—5 of FIG. 4.

A typical block of the present invention is illustrated in FIGS. 4 and 5 of the drawings. As may be seen therein, the block 22 is of rectangular form and is cast with relieved portions to provide the pair of flattened rectangular facing members 24 and 26 and the parallel integral transverse webs 27. These webs are spaced from the ends of the block by a distance equal to one-half the distance between the webs so that when the blocks are laid either in vertical alignment, or overlapping with the joints of the blocks in one of the courses in vertical alignment with the middles of the blocks in the underlying and overlying courses, the webs 27 are all vertically aligned and the relieved portions 31, 32 and 33 accordingly provide the vertically aligned openings 34.

The vertical alignment of the openings 34 accommodates filling of selected vertical openings with liquid concrete grout which, when the grout is allowed to set and harden, provides increased columnar strength to the wall structure. Where all of the vertical openings are filled with liquid concrete grout, the resulting wall or wall panel 21 will be substantially monolithic. Where only the number of columns required to provide the desired structural support are filled with liquid concrete grout, the resulting structure will be lighter, require less material, and possess good heat insulating properties because of the dead air spaces.

While attempts have been made to construct building walls of the type described having selected vertically extending openings filled with liquid concrete grout to provide internal integral load-bearing columns, many problems have been encountered because of the propensity of the liquid grout to leak from the vertical opening being filled into the adjacent vertical openings which are desired to be left empty. This is particularly true of building blocks of the type disclosed in the aforementioned U.S. Pat. No. 3,222,830 to Ivany in which the portions of the notches not occupied by reinforcing rods, and the gap between the upper surface of the block and the lower surface of the next block above offer extensive flow paths for the liquid grout, unless they are carefully filled with cement mortar and allowed to harden sufficiently to prevent hydraulic displacement before the liquid concrete grout is poured.

As may be seen in FIGS. 8 through 11 of the drawings, the present invention provides a novel dam means 43 for preventing unwanted migration or leaking of the liquid concrete grout from one vertical opening 34 to the next. Basically, the dam means 43 fits over the web 27 and any reinforcing rods carried in the notches 28 and 29 in such manner as to substantially seal off the opening between the web 27 and the lower surface 37A of the web 27 in the next block above. With the top of the dam means 43 flush with the upper surface 36 of block 22, the liquid concrete grout is effectively contained in the desired vertical opening 34. Preferably, the dam means 43 is of cast concrete construction, so it will become an integral part of the wall structure upon hardening of the liquid concrete.

The dam means 43 here comprises members 44 of inverted U-shape cross-section having downwardly depending skirts 46 and 47 proportioned to straddle the webs at 27. The member 44 is of a length sufficient to span the relieved portion of the web, see FIG. 9, so as to block flow past the web. The skirts 46 and 47 are formed with inverted notches 48 and 49 corresponding to notches 28 and 29 in web 27 and cooperative therewith for substantially encircling horizontal reinforcing rods 51 supported in the notches 28 and 29. The members 44 are simply dropped into place after the reinforcing rods 51 have been positioned. If desired, members 44 may be secured in place by a bonding agent used to secure the blocks 22 together, although the inverted U-shape cross-section of members 44 with normally eliminate necessity for such bonding.

The strength of the wall panels 21 is materially improved by incorporating steel reinforcing rods into the structure. The horizontal reinforcing rods 51 are laid in the notches 28 and 29 in the desired courses 23A through 23L (see FIGS. 1 and 2). Each of the courses of blocks in which it is desired to position reinforcing rods 51 is formed of the blocks 22 having the above described grooves 28 and 29. Courses of blocks in which reinforcing rods 51 are not required may be constructed from either the blocks 22, or similar blocks (not shown) in which the web 27 extends to the upper surface 36 of the block, the web 27 not being relieved to provide notches 28 and 29.

Vertically extending reinforcing rods 52 also may be positioned in the vertically extending openings 34 into which liquid concrete grout is to be poured for reinforcing the integral vertical columns provided thereby. Ordinarily, the vertical reinforcing bars are positioned in the openings 34 equidistant from the facing members 24 and 26 of the blocks, which provide the outer surfaces of the walls, that is, along the centerline of the wall. Reinforcing rods 51 and 52 of various diameters are incorporated into the wall structure, depending upon particular load and stress factors involved.

Figure 7:
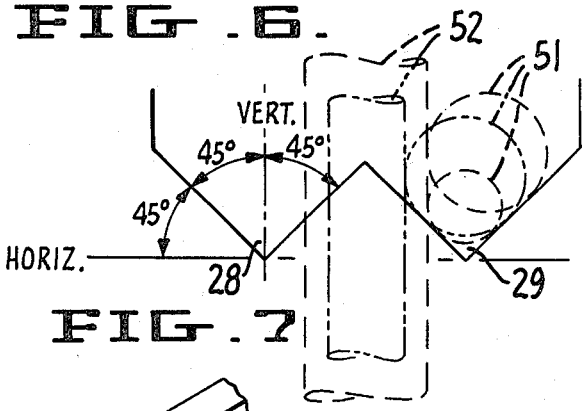
FIG. 7 is an enlarged diagramatic view of the upper end of one of the webs forming a portion of the building block illustrated in FIG. 4 illustrating the automatic positioning effect on different sizes of reinforcing rods afforded by the V-shaped notches in the upper end of such web.
Figure 8:
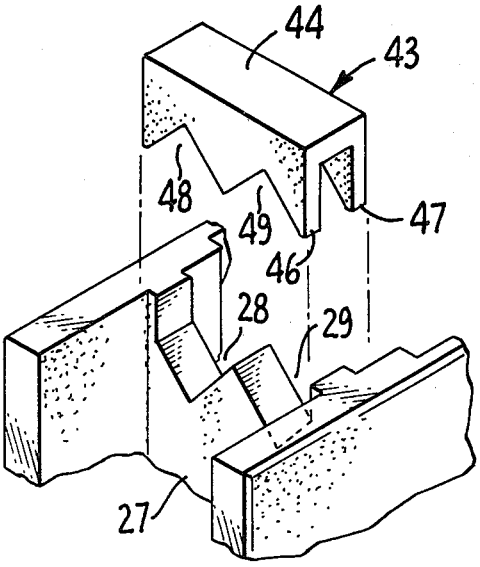
FIG. 8 is an enlarged exploded view of a dam member and the area in which it is mounted for blocking off leakage of liquid grout past the block webs.
Figure 9:
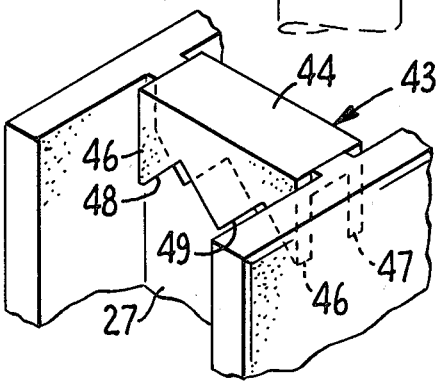
FIG. 9 is a view of the dam member of FIG. 8 mounted in operative association with the surrounding portions of the wall construction of the present invention.
Figure 10:
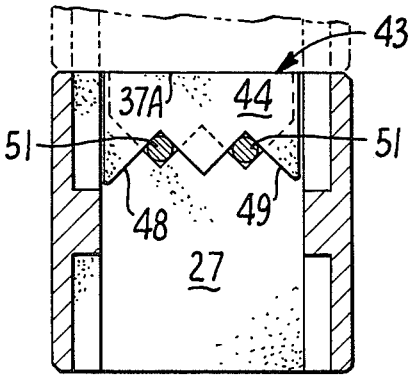
FIG. 10 is a transverse vertical cross-sectional view taken substantially on the plane of line 10—10 of FIG. 11.
Figure 11:
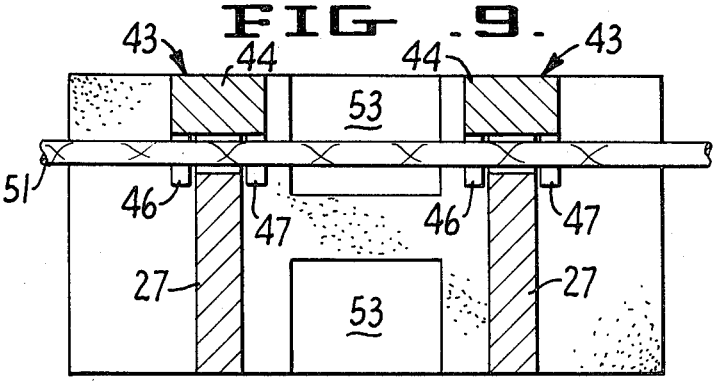
FIG. 11 is a longitudinal vertical sectional view taken substantially on the plane of line 11—11 of FIG. 10.

As a feature of the present invention, the notches 28 and 29 are formed for automatically positioning various sizes of reinforcing rods 51 and 52 in the desired locations. As may be seen in FIG. 7 of the drawings, upon placing of the reinforcing rods 51 in the grooves 28 and 29, the force of gravity causes them to roll or slide to the bottom of the grooves. For this purpose, the grooves are of open V-shape, with the edges of the grooves inclined at approximately 45° to both the vertical and horizontal. With this configuration, the reinforcing rods 51 tend to slide down the outer inclined surfaces of the grooves 28 and 29 and confine the vertical reinforcing rods approximately midway therebetween. This holds true even for reinforcing rods of greatly varying diameters, as illustrated in FIG. 7.

Figure 3:
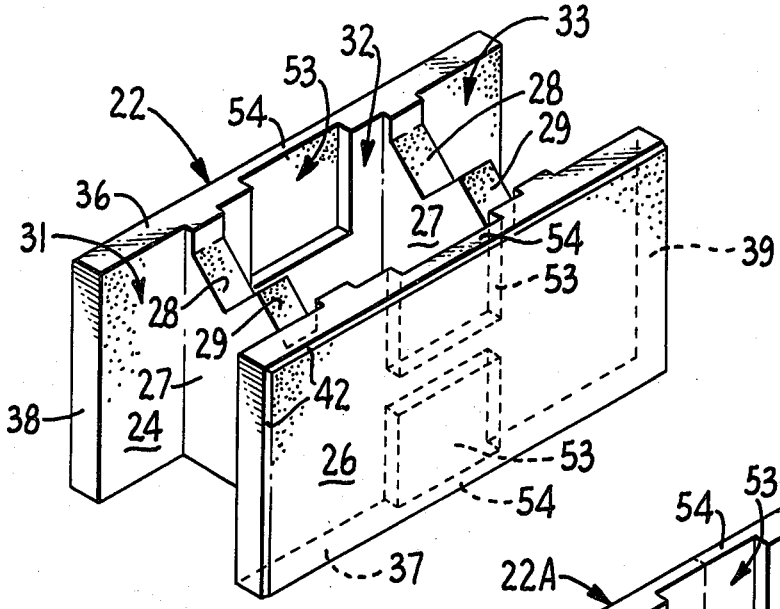
FIG. 3 is an enlarged perspective view of a building block constructed in accordance with the present invention.

In accordance with the present invention, portions of the inner sides of the facing members 24 and 26 are further relieved to provide recesses 53 concealed by relatively thin knockout panels 54 for providing access to the interior of the block 22. As illustrated in FIG. 3 of the drawings, such recesses and knockout panels are preferably positioned adjacent to the upper side 36 and lower side 37 of the block 22, in both of the facing members 24, 26. These recesses 53 provide the additional advantage of receiving the liquid grout so it forms protuberances on the columns and beams, etc. for securely keying the hardened concrete into the blocks.

Figure 6:
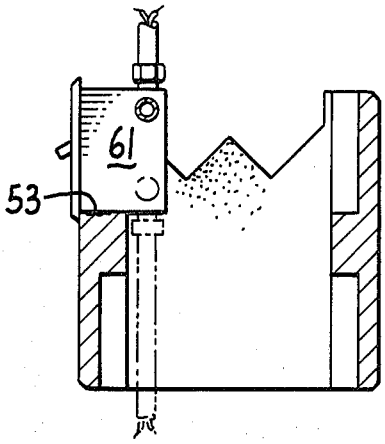
FIG. 6 is a view similar to that of FIG. 5, but illustrating a knock-out panel removed and a switch box mounted in an upper recess of a facing member.

The recesses 53 are of a size to accommodate electrical apparatus of the class comprising outlets, switches and junction boxes in such manner that the outer faces thereof are either substantially flush with the face of the wall, or are concealable by substantially flush closure panels. Typical electrical installations utilizing the described recess and knockout panel construction are illustrated in FIGS. 1, 2 and 6 of the drawings.

This feature of the recesses 53 and knockout panels 54 make it possible to incorporate electrical conduits 56, water or gas pipes 57, and other conduits such as built-in vacuum cleaning tubes, ventilation tubes, etc. (not shown) within the wall structure. In FIG. 1, and electrical conduit 56 extends horizontally along the course 23F and is provided with a covered outlet box 58, a junction box 59, and a switch 61. A typical lighting fixture 62 is mounted high on the wall, by removal of the knockout panel thereat, and is connected to switch box 61 by a vertically extending branch conduit 63 positioned in one of the vertical openings 34. A second branch conduit 64 extends downwardly to communicate with a wall plug box 66 located near the floor.

Figure 1:
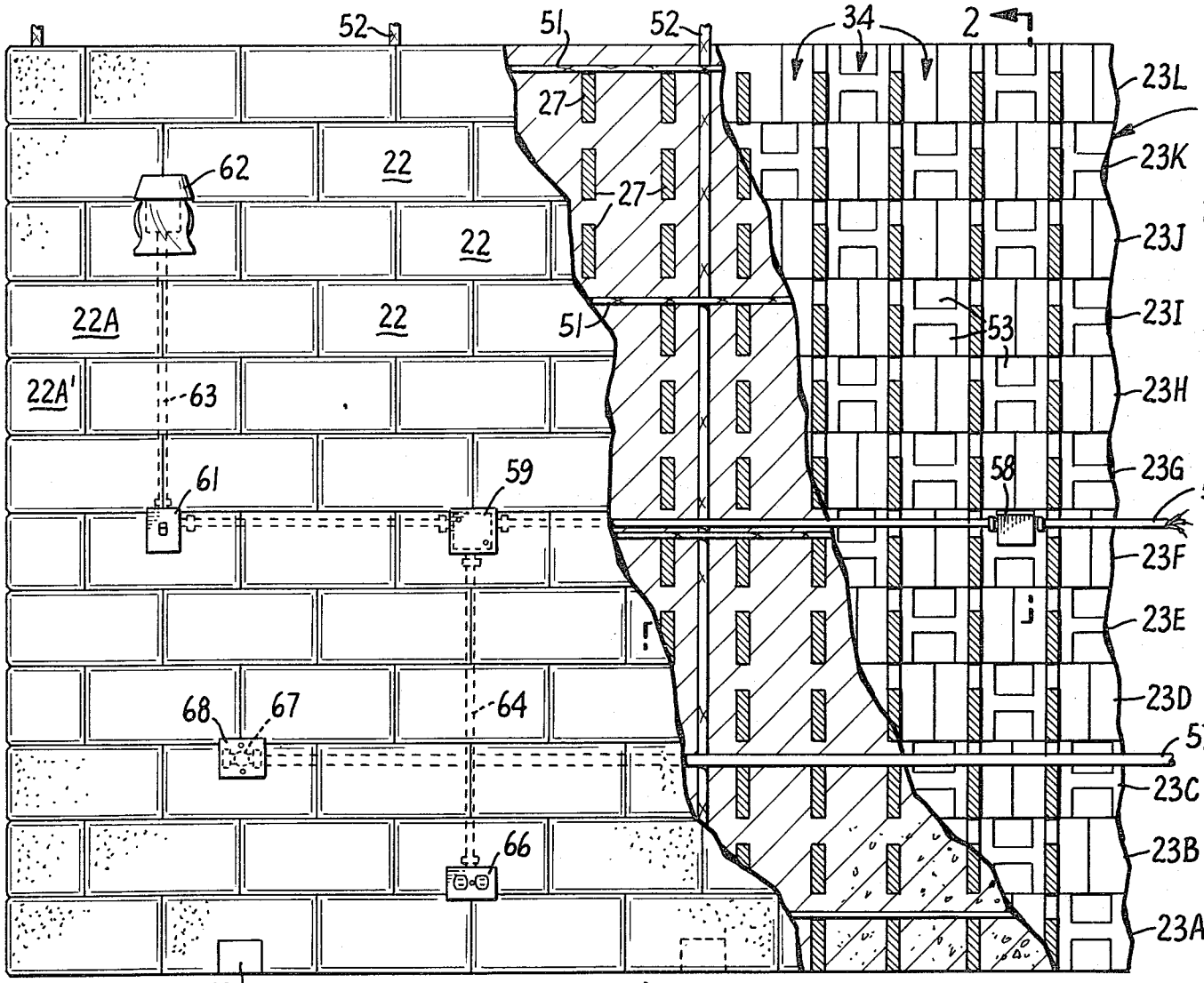
FIG. 1 is a side elevational view of a wall panel constructed in accordance with the present invention and having portions broken away and shown in cross-section for clarity of illustration.

FIG. 1 also shows a water or gas pipe 57 passing horizontally along the length of the wall through course 23C to terminate in a nipple or other fitting 67 covered by a removable, substantially flush plate 68.

As a further feature of the present invention, the knockout panels 54 are also adapted to facilitate the elimination of air bubbles and voids in the liquid grout poured into the vertical openings 34. For this purpose, the knockout panels 54 at the lower side of the blocks in the lowermost course 23A may be removed to provide clean-out passages 69 through which entrapped air is expelled as the pouring of the liquid concrete grout proceeds. When pouring is completed, the removed knockout panel may be reinserted into the opening and held in place by application of the epoxy bonding agent.

Ends of wall panels, and door and window openings, may be completed by utilizing a modified block 22A illustrated in FIG. 4 of the drawings. One-half of block 22A is similar to the corresponding half of block 22 (FIG. 3), but the opposite end is provided with a wall 71 extending between the facing members 24A and 26A so as to provide a finished appearance to the terminator of each course of blocks, and the web 27 in such end may be eliminated. Vertical openings are edged as illustrated in FIG. 1 of the drawings wherein the last block in each course is alternately the block 22A, or a block 22A' consisting of the half of block 22A having the end wall 71.

In certain types of construction, it is desirable that the wall structures possess high resistance to lateral bending moment. Where only a portion of the vertically extending openings are filled with concrete to provide integral internal columns, it is desirable to provide horizontally extending internal beams adapted to resist such lateral bending moment. Ideally, such horizontal beams are integral with both the building blocks and the internal columns so as to provide an internal lattice of integral beams and columns.

Figure 12:
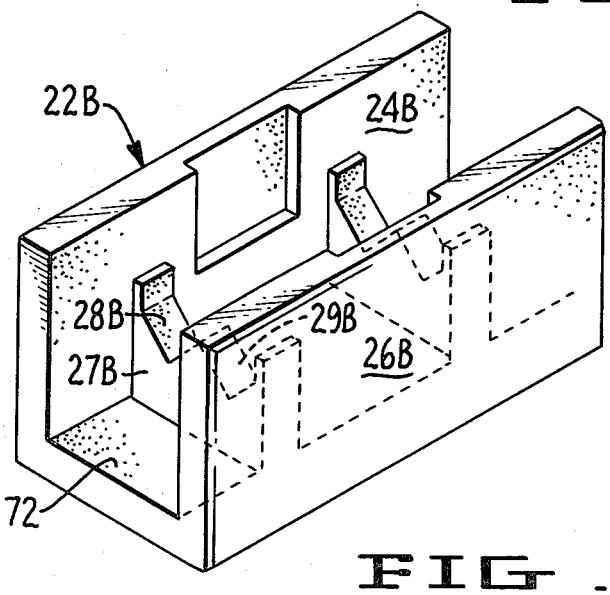
FIG. 12 is an enlarged perspective view of a building block similar to that of FIG. 4, but having an imperforate bottom.
Figure 14:
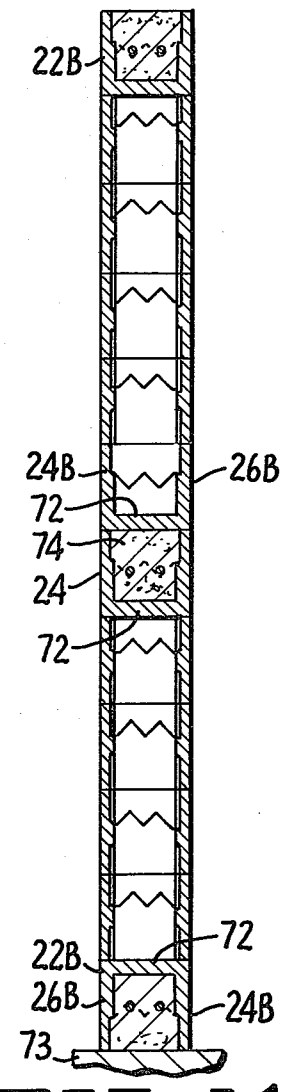
FIG. 14 is a vertical cross-sectional view taken substantially on the plane of line 14—14 of FIG. 13.
Figure 13:
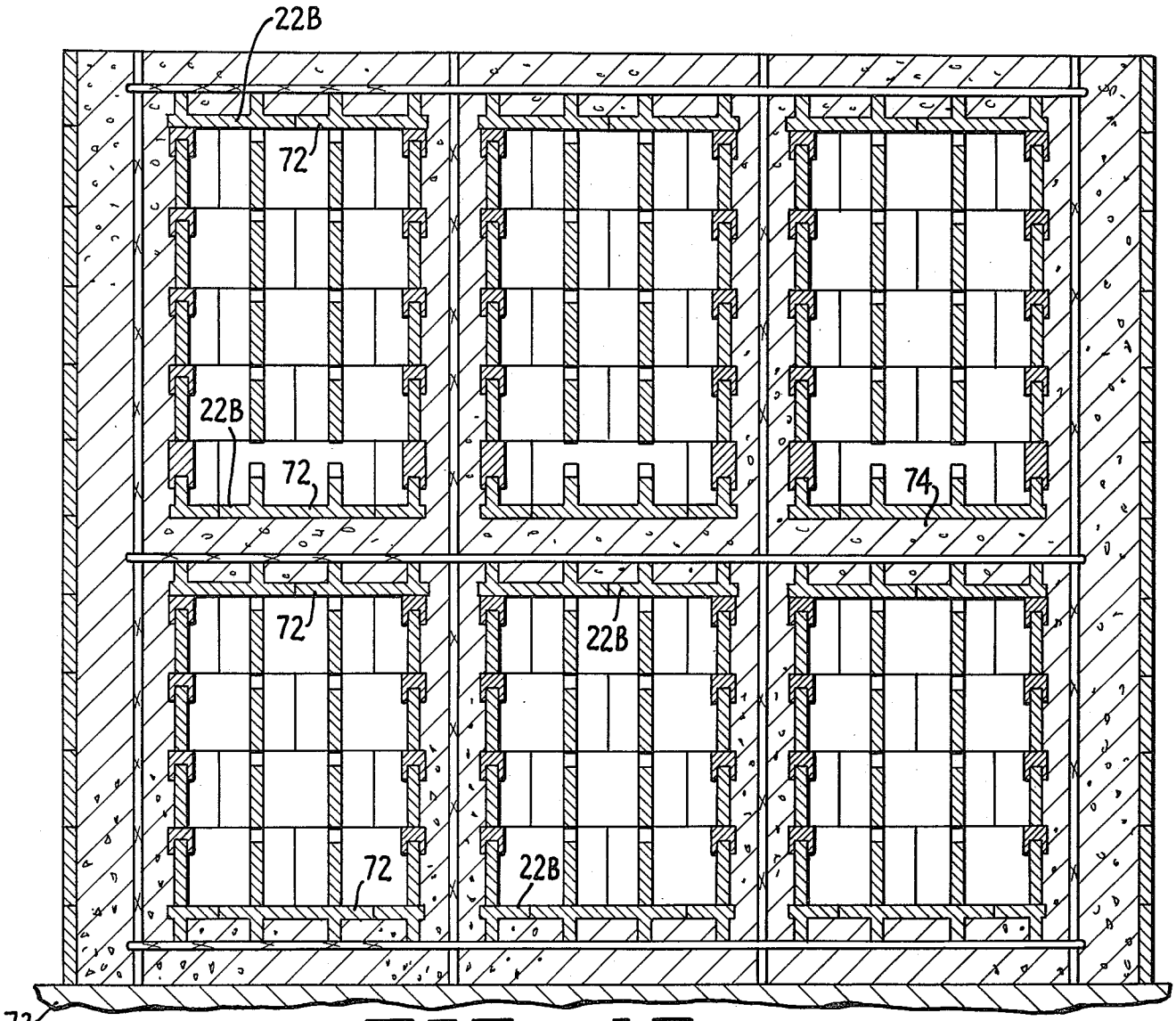
FIG. 13 is a side elevational view of a wall panel construction having integral vertical reinforced columns and integral horizontal transverse reinforced concrete beams, portions of the view being broken away and shown in section for clarity of illustration.

Such internal lattice is herein provided by the structure illustrated in FIGS. 12 through 14 of the drawings. As there shown, the block 22B is of the same general outside dimensions as the blocks shown in FIGS. 3 and 4, and is provided with rectangular facing members 24B and 26B held in parallel spaced relation by transverse webs 27B which, in turn, are provided with notches 28B and 29B for receiving the horizontal reinforcing rods.

A closure member 72 extends across the side of the block opposite to the notches 28B and 29B and is formed integrally with the facing members 24B and 26B to provide a block of substantially U-shaped cross-section.

A course of blocks 22B, laid in the position shown in FIG. 12, is therefore of trough shape and is adapted to receive and contain liquid concrete grout which, when allowed to set and harden, forms the desired horizontal, internal integral beam.

Typical uses of the blocks 22 to form horizontal beams are illustrated in FIGS. 13 and 14 of the drawings. As there shown, horizontally extending beams are provided at the top, bottom, and half-way up the wall panel depicted. The lower beam is formed by inverting the lowermost course of blocks 22B so the liquid concrete grout will be confined between the facing members 24B, 26B, the closure member 72, and the subjacent floor 73.

The beam half-way up the wall is confined to the cavity 74 defined by the closure members 72 and facing members 24B and 26B of one course of blocks 22B, the cavity 74 being closed off by the closure member 72 of a second course of blocks 22B laid immediately above.

The upper beam is poured into the open trough provided by the uppermost course of blocks, which also comprise blocks 22B.

It should be noted that the webs 27B are preferably much lower than the corresponding webs 27 in blocks 22 and 22A. This lowering of the webs 27B provides relatively large openings for improved lateral flow of the liquid concrete grout along the horizontal cavity or trough provided by the courses of blocks 22B, and positions the reinforcing steel low in the beam for strength.

From the foregoing, it will be seen that the present invention provides a novel and highly efficient system for building wall construction which is extremely versatile and which provides wall structure which is stronger, lighter, and more pleasing in appearance than has heretofore been obtainable with building block construction.

What is claimed is:

1. A system for building wall construction, comprising a plurality of hollow cast concrete blocks of rectilinear form laid up in stacked courses to define a wall, said blocks being formed with spaced transverse webs defining vertically aligned openings extending substantially the height of said wall, the upper portions of said webs being relieved to define grooves providing openings for horizontal reinforcing rods, cast concrete closure members positioned at selected of said grooves and formed for preventing communication thereat between adjacent of said vertically aligned openings, and an epoxy bonding agent securing together confronting surfaces of said blocks.

2. A system for building wall construction as described in claim 1, and wherein said blocks are formed with thin knockout panels at selected locations for providing access to the interior of said wall.

3. A system for building wall construction as described in claim 2, and wherein selected of said vertically aligned openings are filled with concrete.

4. A system for building wall construction as described in claim 3, and wherein vertically extending reinforcing rods are positioned in said vertically extending aligned openings, and horizontally extending reinforcing rods are positioned in said notches, the 45° angle of the sides of said notches providing automatic alignment of said horizontally extending reinforcing rods.

5. A system for building wall construction as described in claim 4, and wherein said side faces are beveled along the junctures of their outer faces with the upper and lower and end faces of said blocks so as to provide V-shaped grooves along the joints between adjacent blocks.

6. A building block construction, comprising a rectangular cementitious block having portions relieved to provide a pair of flattened rectangular facing members held in parallel spaced relation by integral transverse webs, said webs being cut away at the side of the block intended to be the upper side to provide a pair of V-shaped notches having straight sides inclined at an angle of substantially 45° from the upper side of said block, said webs being spaced from the ends of said block by a distance equal to one-half the distance between said webs, and a cementitious closure member formed for removable mounting across the opening between each of said webs and said upper side of said block except for openings between said closure member and said notches adapted to receive horizontal reinforcing rods.

7. A building wall panel, comprising a plurality of rectangular cementitious blocks laid up in stacked courses to define the wall panel, each of said blocks having portions relieved to provide a pair of flattened rectangular facing members held in parallel spaced relation by integral transverse webs, said webs being cut away at the upper side of said blocks to provide passages between laterally adjacent relieved portions and being formed with a pair of V-shaped notches having straight sides inclined at an angle of substantially 45° from the upper sides of said blocks, said webs being spaced from the ends of each of said blocks by a distance equal to one-half the distance between said webs, whereby said webs are substantially vertically aligned and said relieved portions form vertically extending aligned openings when said blocks are laid in either one-half overlapping or vertically aligned courses, and a cementitious closure member mounted across the opening between each of said webs and the lower side of the aligned superjacent web, whereby concrete poured into one of said vertically extending openings will be confined against running into the adjacent vertically extending opening.

8. A building wall panel as described in claim 7, and wherein vertically extending reinforcing rods are positioned in said vertically extending aligned openings, and horizontally extending reinforcing rods are positioned in said V-shaped notches, said closure member having relieved portions cooperative with said notches for accomodating said horizontally extending reinforcing rods.

9. A building wall panel as described in claim 8, and wherein said closure member is of inverted U-shaped cross section having skirt portions proportioned to straddle said web for holding said closure member in place against hydraulic pressure of liquid concrete grout.

* * * * *